United States Patent [19]

Sasaki et al.

[11] Patent Number: 4,835,956

[45] Date of Patent: Jun. 6, 1989

[54] BULKY FLAT YARN OF SILKY TOUCH AND A PROCESS FOR MANUFACTURING THE SAME

[75] Inventors: Yoshiyuki Sasaki, Takatsuki; Katsuyuki Kasaoka, Ibaraki, both of Japan

[73] Assignee: Teijin Limited, Osaka, Japan

[21] Appl. No.: 647,252

[22] Filed: Aug. 31, 1984

Related U.S. Application Data

[63] Continuation of Ser. No. 565,134, Dec. 27, 1983, abandoned, which is a continuation of Ser. No. 249,490, Mar. 31, 1981, abandoned.

[30] Foreign Application Priority Data

Apr. 2, 1980 [JP] Japan ..... 55-41941
Apr. 17, 1980 [JP] Japan ..... 55-49525

[51] Int. Cl.[4] ..... D02G 3/04; D02J 1/04; D02J 1/06

[52] U.S. Cl. ..... 57/245; 28/220

[58] Field of Search ..... 28/220; 57/245

[56] References Cited

U.S. PATENT DOCUMENTS

| | | | |
|---|---|---|---|
| 3,423,809 | 1/1969 | Schmitt | 28/220 X |
| 3,803,282 | 4/1974 | Hamana et al. | 28/220 X |
| 3,892,021 | 7/1975 | Izawa et al. | 28/220 |
| 3,946,468 | 3/1976 | Satterwhite | 28/220 |
| 4,153,660 | 5/1979 | Reese | 28/220 X |
| 4,295,329 | 10/1981 | Windley | 28/220 X |

FOREIGN PATENT DOCUMENTS

| | | | |
|---|---|---|---|
| 674165 | 11/1963 | Canada | 28/220 |
| 1223119 | 2/1971 | United Kingdom | 28/220 |

*Primary Examiner*—Robert R. Mackey
*Attorney, Agent, or Firm*—Burgess, Ryan & Wayne

[57] ABSTRACT

A process for manufacturing a bulky flat yarn comprising: preparing at least two kinds of thermoplastic synthetic undrawn yarns having different natural draw ratios, respectively; simultaneously drawing said prepared yarns at a draw ratio which is equal to or larger than the smallest natural draw ratio of the yarns and which is equal to or smaller than the largest natural draw ratio; and releasing drawing tension in the yarns after they are drawn. The yarns are mixed by means of an interlacing air nozzle before or after they are drawn.

9 Claims, 11 Drawing Sheets

BULKY FLAT YARN OF SILKY TOUCH AND A PROCESS FOR MANUFACTURING THE SAME

BRIEF DESCRIPTION OF THE INVENTION

The present invention relates to a process for manufacturing a bulky flat yarn.

BACKGROUND OF THE INVENTION

Various processes are known by which a filament yarn is provided with bulkiness.

According to one process, a multifilament yarn is subjected to a false twisting and twists running back along the yarn are heat set, and then the false twisted filaments are opened so that a so-called woolly type yarn is produced. Although such a woolly type yarn is bulky enough, it does not have an appropriate bending resiliency.

According to another process, a so-called Taslan (Registered Trade Mark owned by Du Pont de Nemours) yarn is produced by wrapping a wrapper yarn about a core yarn by means of a fluid nozzle. However, since such a Taslan yarn has a stiff core portion, it has an inferior hand.

Furthermore, the above-mentioned woolly type yarn and Taslan yarn require an additional step for false twisting the yarn and for fluid treating the yarn, respectively, and accordingly, the manufacturing processes are complicated.

In a still another widely utilized process, yarns having different shrink properties are first mixed. Then, the mixed yarns are subjected to a heat treatment in a dyeing and finishing process after the mixed yarns are woven into a fabric so that a difference in shrinkages is created and so that the bulkiness of the fabric is increased. However, since this process relates to a spontaneous contracting force of the fibers in the dyeing and finishing process, the obtained bulkiness is usually restricted, and it cannot be expected to obtain a yarn having a sufficiently high bulkiness.

SUMMARY OF THE INVENTION

An object of the present invention is to provide a process for manufacturing a bulky flat yarn wherein the difference in elasticity recovery of constituent yarns is utilized rather than that in the shrinking properties of constituent yarns so that a filament yarn having a large bulkiness can be obtained.

According to the present invention, the object is achieved by a process comprising: a step for preparing at least two kinds of thermoplastic synthetic yarns having a different natural draw ratio, respectively; a step for simultaneously drawing said prepared yarns at a draw ratio which is at least the smallest natural draw ratio of said yarns and which is at most the largest natural draw ratio of said yarns; and a step for mixing said prepared yarns.

According to the present invention, additional texturing steps, such as false twisting, are unnecessary, and accordingly, the yarn does not have any crimps which are usually created by the texturing operation, and therefore, a bulky yarn of silky touch which has both a high bulk and resiliency can be obtained.

BRIEF DESCRIPTION OF THE DRAWINGS

Some embodiments of the present invention will now be explained with reference to the accompanying drawings, wherein.

DETAILED DESCRIPTION OF THE PRESENT INVENTION

Figure 1:
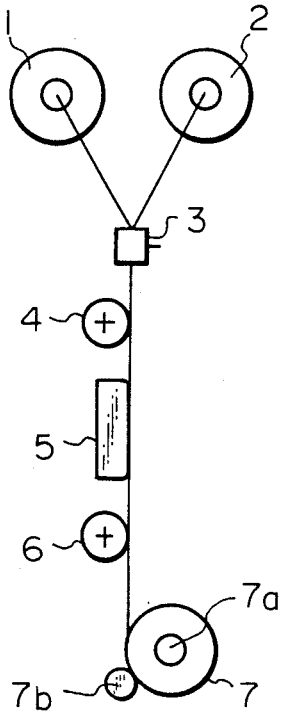
FIG. 1 is a diagrammatical elevational view illustrating an embodiment of the present invention.

Referring to FIG. 1 illustrating an embodiment of the process according to the present invention, 1 denotes an undrawn polyester yarn, for example, of 150 denier/36 fil, having a birefringence ($\Delta n$) of 0.012 and a natural draw ratio of 1.9 and obtained through a melt spinning at a speed of 1300 m/min; and 2 also denotes a undrawn or partially drawn polyester yarn having a higher birefringence ($\Delta n$) than that of the undrawn polyester yarn 1, for example, of 78 denier/ 36 fil, having a birefringence ($\Delta n$) of 0.051 and natural draw ratio of 1.3 and obtained by a melt spinning operation at a speed of 3500 m/min. The yarns 1 and 2 are withdrawn and then are mixed in a combined yarn by interlacing by means of a conventional turbulent fluid nozzle 3. The mixed yarn is then preheated to a predetermined temperature (which will be explained later) by means of a conventional hot roller 4 while it wraps therearound. The preheated yarn is heated at a predetermined temperature (which will also be explained later) by means of a conventional plate heater 5 which is electrically heated, and it is delivered to a conventional draw roller 6 whose peripheral speed is higher than that of the hot roller 4, and accordingly, the yarn is drawn at a predetermined draw ratio, for example, of 1.7, so that the yarn is transformed into a filament yarn of about 140 denier/72 filament. The filament yarn is taken up at a speed of 800 m/min by way of a take up 7 which comprises a bobbin holder *7a* for rotatably supporting a yarn take up bobbin and a friction roller *7b* for driving the bobbin.

Figure 2:
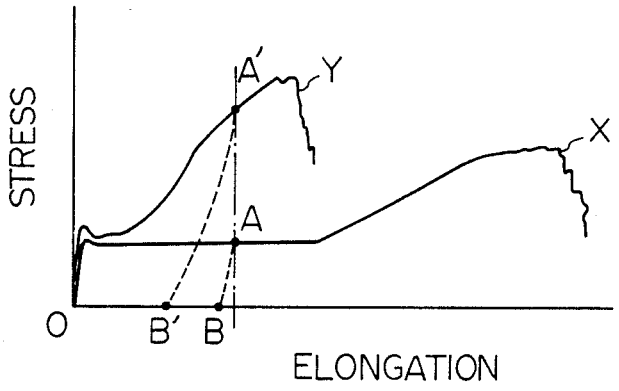
FIG. 2 is a diagram illustrating the recovery of the load and elongation and is utilized to explain the principle of the present invention.
Figure 3A:
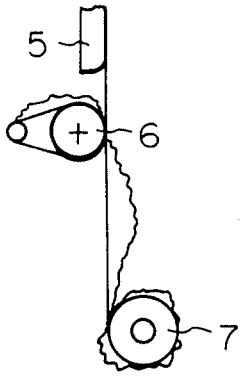
FIGS. 3A and 3B are partial elevational views illustrating the behavior of yarns.
Figure 3B:
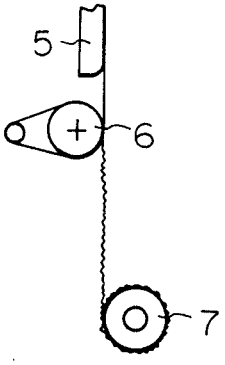
Figure 4:
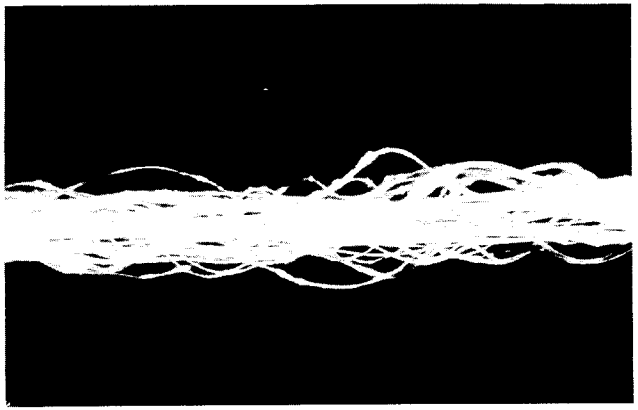
FIG. 4 is a side view (a micrograph, enlarged 25 times) of a bulky yarn obtained through the process of the present invention.

In this process, the yarns 1 and 2 composing the mixed yarn behave in different manners when they are subjected to the actual draw ratio, i.e., 1.7. More specifically, the yarn 1 is deformed along a strain stress curve X in FIG. 2, and accordingly, when it is drawn at a draw ratio of 1.7, i.e., elongation of 70%, it is subjected to a stress designated by A. Thereafter, when the stress is released, in other words, when the yarn 1 leaves the draw roller 6 in FIG. 1, the stress and strain in the yarn 1 change along a broken line A B to the point B. Similarly, the yarn 2 reaches the point A′ when it is drawn at a draw ratio of 1.7, and it displaces to B′ when the drawing tension is released. In this case please note that when the yarns 1 and 2 are equally drawn, the yarn 2 is subjected to a greater stress than the yarn 1, and that accordingly, the yarn 2 is returned more than the yarn 1 by a distance equal to that between the points B and B′ when the drawing tension is released. As a result, the yarns 1 and 2 leaving the draw roller 6 in FIG. 1 generate a difference in their lengths. If any mixing operation has not previously been applied to the yarns 1 and 2, the yarn 1 may slack as illustrated in FIG. 3A. However, since the yarns 1 and 2 have been subjected to a mixing operation by means of the turbulent fluid nozzle 3 as explained above, the difference in their lengths appears as bulkiness. More specifically, filaments resulting from the yarn 2 highly contract due to the large change in length caused by the tension relief as soon as it leaves the draw roller and locate at the core portion of the obtained yarn. Contrary to this, filaments resulting from the yarn 1 slightly contract and their length is approximately unchanged. Since the yarns 1 and 2 have been mixed and interlaced by way of turbulent fluid nozzle, the approximately unchanged filaments of the yarn 1 bulge out from the core portion at a small pitch equal to the distance between adjacent interlace points, and the obtained yarn is applied with an apparent bulkiness as illustrated in FIG. 3B. FIG. 4 is a micrograph of the thus obtained yarn.

Figure 5:
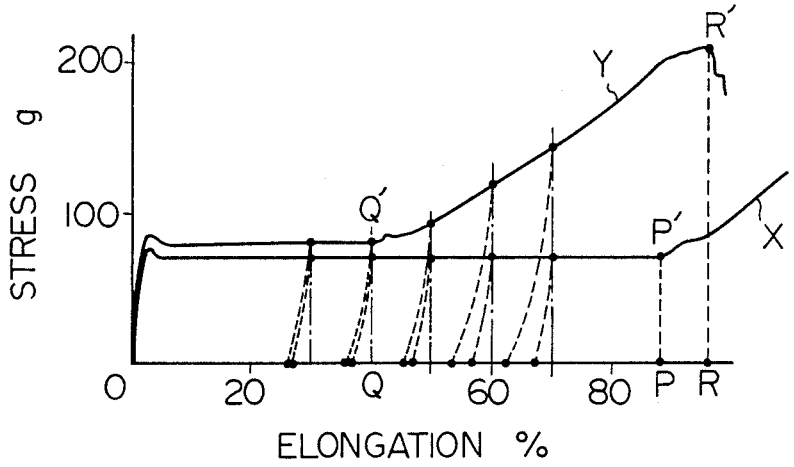
FIG. 5 is a strain and stress diagram utilized to illustrate range of draw ratio which is applicable to the present invention.
Figure 6:
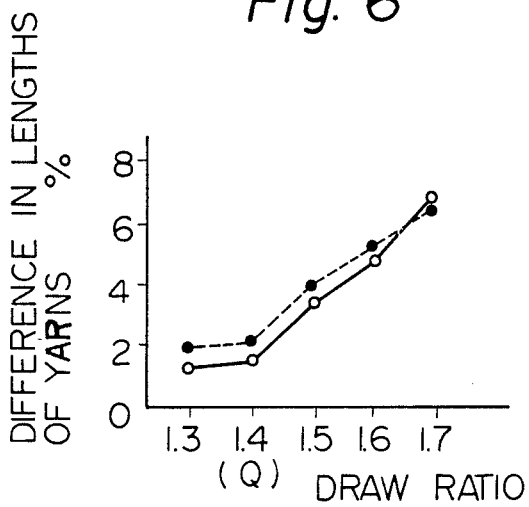
FIG. 6 is a diagram illustrating the relationship between the draw ratio and the difference in yarn lengths.
Figure 7:
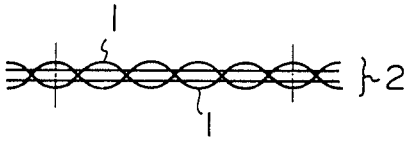
FIG. 7 is a diagrammatical view illustrating the method for measuring the difference in yarn lengths.

The bulkiness of the obtained yarn relates to the relationship between the natural draw ratios of the constituent yarns and the draw ratio applied thereto during the process in FIG. 1. The relationship will now be explained with reference to FIG. 5. The natural draw ratios of the two kinds of the yarns 1 and 2, the strain stress curves of which are denoted by X and Y, respectively, are denoted by P and Q, respectively. If the draw ratio is less than the natural draw ratio Q of the undrawn yarn 1, the difference in the lengths of the yarns is slight. However, as the draw ratio exceeds the natural draw ratio Q, the difference in the lengths of the yarns rapidly increases. FIG. 6 is a diagram illustrating the relationship between the difference in lengths of the yarns and the draw ratio. The white circles and a solid line in FIG. 6 express the values calculated based on FIG. 5, and the black circles and a broken line designate the measured results which are obtained by measuring the obtained yarn cut for a predetermined length as illustrated in FIG. 7. It is obvious that the solid line and the broken line in FIG. 6 show a similar tendency.

Figure 8:
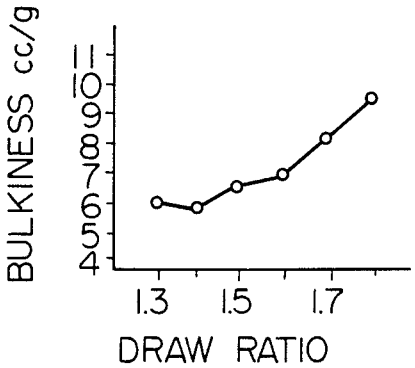
FIG. 8 is a diagram illustrating the relationship between the draw ratio and bulkiness.
Figure 9A:
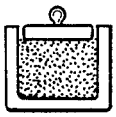
FIG. 9A is an elevational view illustrating method for measuring the bulkiness of a yarn.
Figure 9B:
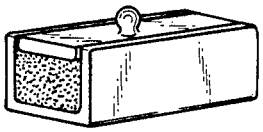
FIG. 9B is a perspective view of FIG. 9A.

FIG. 8 illustrates the relationship between the draw ratio and the bulkiness which is measured in accordance with the filling method which is illustrated in FIGS. 9A and 9B and which will be explained in detail later. From FIGS. 6 and 8, it is concluded that as the draw ratio is increased from the natural draw ratio Q, the difference in the lengths of the yarns is increased (FIG. 6) and at the same time the bulkiness is also increased (FIG. 8). In conclusion, in order to obtain a large bulkiness, the draw ratio must be chosen at a value larger than the smaller natural draw ratio, i.e., Q in FIG. 5. Incidentally, when the draw ratio exceeds the natural draw ratio of the other yarn, i.e., the larger draw ratio expressed by P in FIG. 5, since the stress recovery ratio of the other yarn also increases, the difference in the lengths of the yarns becomes small, and accordingly, the bulkiness of the obtained yarn is again decreased. Therefore, such a high draw ratio is not preferable. Furthermore, if the yarns are drawn to such an extent that either one of the constituent yarns is drawn beyond its breaking strength, the yarn is stretch broken. Therefore, such a condition should be avoided in order to maintain the process stable The above-mentioned bulkiness of the obtained yarn is measured in accordance with the filling method along the following steps. The yarn to be measured is wrapped into a skein for 120 turns by way of a reeling machine, the peripheral length of which is 1.125 m, and the skein is folded in two to form a sample of 64,000 denier, and then a load of 6 g is attached to one end of the sample, and after the sample is heat treated for 5 minutes at a dry heat condition of 195° C., it is cooled. Thereafter, the yarn is filled into a box having a height of 2.5 cm, a width of 1.0 cm, a length of 10 cm and a radius of 0.5 cm at the inner bottom and illustrated in FIGS. 9A and 9B, and then it is weighted by the cover, the weight of which is 6 g. The bulkiness of the yarn is calculated based on its weight (W g) and its volume (V $cm^3$) as follows.

Bulkiness ($cm^3/g$) = V/W

The draw ratio of the present invention must meet with the following requirements. (1) It must be equal to or larger than the smallest natural draw ratio of the supplied constituent yarns. (2) It must be equal to or smaller than the largest natural draw ratio of the supplied constituent yarns. (3) The elongations of the supplied constituent yarns when they are drawn at the draw ratio are smaller than the smallest breaking elongation of the supplied constituent yarns.

In the above-explained example, the two kinds of constituent yarns were supplied, however it should be noted that the present invention is also applicable to such an example wherein three or more constituent yarns are supplied as long as the above-mentioned requirements are satisfied by the selected draw ratio.

Figure 10:
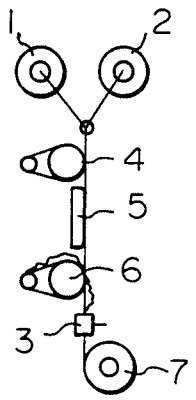
FIG. 10 is a diagrammatical elevational view of another embodiment of the present invention.
Figure 11A:
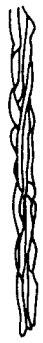
FIGS. 11A and 11B are side views of yarns manufactured by the process of the present invention.
Figure 11B:
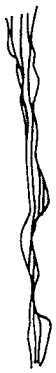

In addition, although in the above-explained embodiment the mixing of the constituent yarns were carried out before they were drawn, it may be carried out after they are drawn as illustrated in FIG. 10 wherein the same parts as those illustrated in FIG. 1 are denoted by the same reference numerals and their further explanation is omitted and only differences are explained. In FIG. 10, a conventional turbulent fluid nozzle 3 is arranged between the draw roller 6 and the take up 7, and the hot roller 4 and the draw roller 6 are followed by separate rollers. Two yarns, which leave from the draw roller 6 and one of which is slack, are subjected to a mixing operation by means of the turbulent fluid nozzle 3. However, it should be noted that when yarns are subjected to a mixing operation after they are drawn as illustrated in FIG. 10, the appearance of the obtained yarn becomes somewhat irregular. More specifically, when the constituent yarns are mixed before they are drawn as illustrated in FIG. 1, a bulky yarn having a uniform appearance as illustrated in FIG. 11A can be obtained because one of the previously mixed yarns uniformly bulges from the core portion. Contrary to this, when the constituent yarns are mixed after they are drawn as illustrated in FIG. 11B, the constituent yarns having different lengths are forced to be mixed, and accordingly, as illustrated in FIG. 11, separated portions are mixed with the core portion. If the constituent yarns which have been mixed and then drawn, are again subjected to a mixing operation after they are drawn, the mixing efficiency is enhanced, and accordingly, a uniformly bulky yarn can be produced.

Although in the above-explained examples, a turbulent fluid nozzle which is supplied with air is utilized for the mixing operation, any other means which is capable of mixing can be used.

Figure 12:
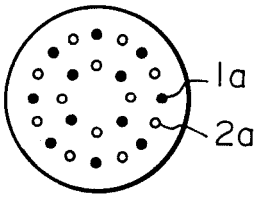
FIG. 12 is a plan view illustrating a spinneret utilized in a further embodiment of the present invention for mixing yarns.

FIG. 12 is a plan view of a spinneret for mixing filaments in a spinning step, and the spinneret is used in a melt spinning so that two kinds of undrawn yarns which vary in their natural draw ratios are spun through holes 1*a* and 2*a* by varying the materials of the supplied polymer, the degrees of polymerization, the thickness, or the cross sectional shapes of the constituent filaments of the yarns and the filaments are mixed while they are spun.

Figure 13:
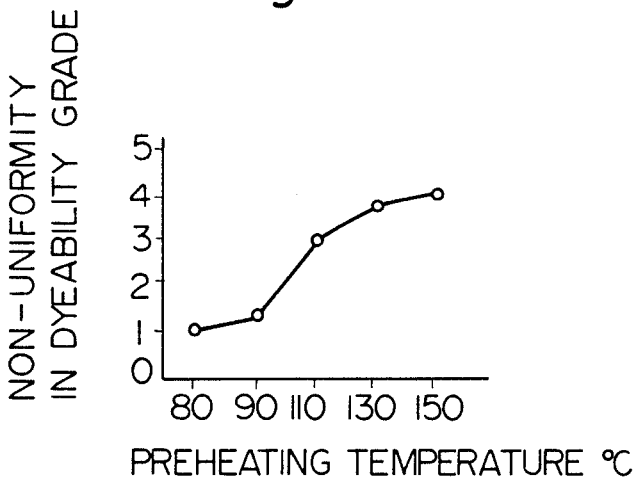
FIG. 13 is a diagram illustrating the relationship between preheating temperature and non-uniformity in dyeability.

In the present invention, a part of the yarns is drawn at a draw ratio of at most the natural draw ratio, the yarn may often be non-uniformly drawn. If such a non-uniformity in drawing must be avoided, it is preferable that the yarns are heated at a high temperature while they are being drawn. More specifically, as illustrated in FIG. 13, if the yarns are preheated at a temperature of at most the glass transient temperature plus 20° C., for example, at a temperature of between 80° and 90° C. which is common for the usual drawing of a polyester yarn, non-uniformity in drawing, and as a result, non-uniformity in dyeability, are generated. To obviate such non-uniformity, it is preferable that the yarns are preheated at a temperature of between 100° and 150° C., which is considerably higher than a usually applied temperature. More specifically, in a usual drawing operation, a yarn is preheated at a temperature of at most the glass transient temperature plus 20° C. and is drawn at a relatively high draw ratio so that a fully drawn yarn is produced. Contrary to this, when the yarns in the present invention are preheated at a high temperature which is higher than the glass transient temperature by a temperature gradient of between 30° C. and 80° C., the yarns are fully drawn without causing any substantial non-uniformity in drawing in spite of adoption of a relatively low draw ratio. Because of a reason similar to this, the heating of the yarns at a high temperature of at least 150° C. by means of a heating plate while the yarns are drawn is preferable to avoid the non-uniformity in drawing.

Figure 14:
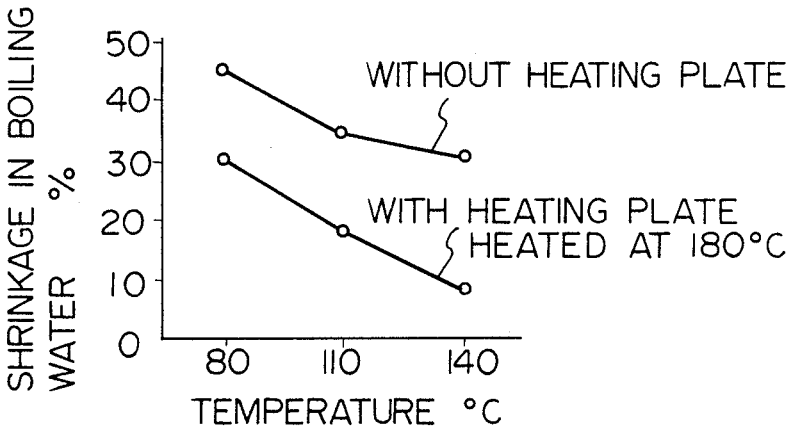
FIG. 14 is a diagram illustrating the relationship between preheating temperature and shrinkage in boiling water.

Such a high temperature drawing as explained above is desirable to maintain the bulkiness of the obtained yarn unchanged. More specifically, if the shrinkage of the obtained yarn which has been drawn is large, the fibers bulging from the core portion and serving to enhance the bulkiness may be shrunk while the yarn is subjected to a dyeing operation. However, if the yarns are preheated by means of a hot roller heated at a high temperature and then are heated by means of a plate heater heated at a high temperature, the shrinkage of the obtained yarn in boiling water is reduced as illustrated in FIG. 14, and accordingly, the bulkiness of the obtained yarn is not deteriorated while the yarn is subjected to the subsequent dyeing operation.

Since in the present invention, the yarns which are exposed to different stresses while they are being subjected to a drawing step create a bulkiness in the finally obtained combined yarn when the drawing tension in the yarns is released after the drawing step, it is necessary that the combined yarn is subjected to such a condition as that desirable for fully losing the stress after it is drawn. However, it should be noted that a part of the constituent yarns is subjected to such a large stress as being fully elongated, and that the tension in the yarn created while the yarn is taken up by means of, for example, a winder or a ring twister is comparatively smaller than the above-mentioned stress. Accordingly, unless special care is taken into consideration, the stress applied to the constituent yarns during the drawing step is lost through usual handling.

Figure 15A:
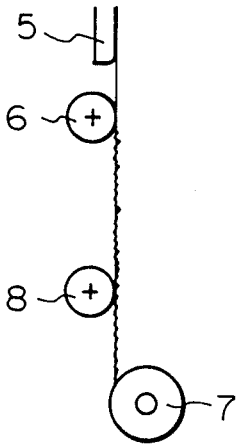
FIGS. 15A and 15B are diagrammatical elevational views illustrating still further embodiments of the present invention.
Figure 15B:
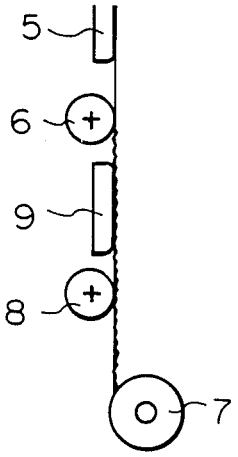

To enhance the diminishing of the stress, an additional zone may be formed downstream of the draw roller 6 by arranging an additional roller 8 as illustrated in FIG. 15A. Due to the roller 8, the winding tension created by the take up 7 is cut, so that the tension in the recovering zone is maintained at a predetermined level. Furthermore, as illustrated in FIG. 15B, a second heating plate 9 may be arranged in this zone so that the drawn yarn leaving the draw roller 6 is appropriately heat set. Especially large loops in the fibers bulging from the core portion are thermally shrunk, and as a result, a bulky yarn having a silky touch and a uniform appearance with small bulged portions can be obtained.

Undrawn yarns utilized in the present invention may be a polyester which creates a sufficient stiffness, a large bending elasticity and a dimensional stability, and may also be other materials, for example a modified polyester including a third component such as 5-sulfosodium isophthalic acid and being dyeable in basic dyes or nylon, as long as they are undrawn yarn having a certain natural draw ratio. The polymers of the undrawn yarns may be identical in some cases, and they may be different in some cases for creating a difference in color due to the different polymer or for increasing the hand due to the combination of polymers. The undrawn yarns may have an irregular cross section, such as trilobal cross section, and they may be composed of filaments having different deniers. In short, the natural draw ratio of the constituent yarns are adjusted by varying the spinning speeds, the deniers of the constituent filaments, and the kinds of the constituent yarns.

Figure 16:
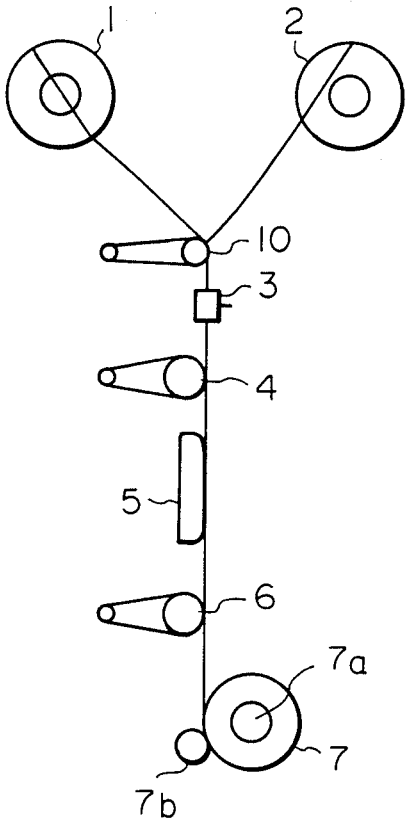
FIGS. 16, 17 and 18 are diagrammatical elevational views utilized in other embodiments of the present invention.

In an embodiment illustrated in FIG. 16 which is the same as FIG. 1 except that a tension adjusting roller 10 is disposed upstream of the turbulent fluid nozzle 3, the tension adjusting roller 10, the hot roller 4 and the draw roller 6 are coupled with separate rollers. As an undrawn polyester yarn 1 having a birefringence ($\Delta n$) of at most 0.018, for example, 0.011, spun at a speed of 1300 m/min, having a natural draw ratio of 2.5, and comprising 300 denier/96 fil, and an partially oriented polyester yarn (PET-POY) 2 having a birefringence (Δn) of at least 0.023, for example, 0.043 spun at a speed of 3500 m/min, having a natural draw ratio of 1.3, and comprising 225 denier/48 fil, are withdrawn by means of the adjusting roller 10. The yarns 1 and 2 are slackened at a slacking ratio of between 0.5 and 5.0%, for example, 2.0%, between the adjusting roller 10 and the hot roller 4 which is preheated at a temperature of 130° C., and there they are together subjected to a turbulent fluid operation by means of, for example, an interlace nozzle, the pneumatic pressure of which is, for example, 3 kg/cm$^2$. The interlaced yarns are drawn between the hot roller 4 and the draw roller 6 at a draw ratio, for example of 1.8, which is smaller than the natural draw ratio, for example, of 2.5, of the yarn 1, and which is larger than the natural draw ratio, for example, of 1.3, of the yarn 2, and the yarns are heat set by means of the plate heater 5 heated at a temperature of at least 150° C., for example 180° C. Leaving the draw roller 6, the draw tension in the yarns is released so that a bulky flat yarn applied with high bulkiness due to the difference in the elasticity recovery properties of the yarns is obtained. According to the embodiment illustrated in FIG. 16, the tension in the yarns which being interlaced is specially adjusted so that the yarns are uniformly mixed.

Figure 17:
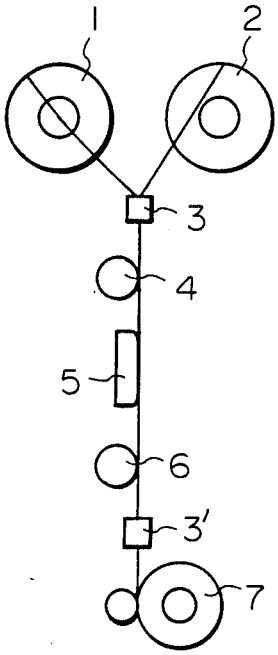

In an embodiment illustrated in FIG. 17 which is a combination of FIGS. 1 and 10, an undrawn polyester yarn 1 with a birefringence (Δn) of at most 0.018, for example 0.015, and an undrawn polyester yarn 2 with a birefringence (Δn) of at least 0.023, for example, 0.05, are withdrawn and are mixed into a yarn by means of a first interlacing fluid nozzle 3. The mixed yarn is drawn at a draw ratio which is equal to or smaller than the natural draw ratio of the yarn 1 and which is equal to or larger than the natural draw ratio of the yarn 2 while they are heated by means of the plate heater 5. After the mixed drawn yarn leaves the draw roller 6, the draw tension is released so that the mixed yarn is applied with bulkiness due to the difference in the elasticity recovery properties, and at the same time, the yarn is again subjected to a turbulent air treatment by means of another interlacing nozzle 3'. As a result of twice interlacing treatments, a yarn having a uniform appearance can be produced.

In still another embodiment, apparatus illustrated in FIG. 1 is utilized, an undrawn polyester yarn 1 having a birefringence (Δn) of at most 0.014, for example, of 0.01 and a partially oriented polyester yarn (PET-POY) 2 having a birefringence (Δn) of at least 0.027, for example, of 0.04, are withdrawn and gathered together, and then they are mixed into a yarn by means of the interlacing air nozzle 3. Thereafter, the mixed yarn is preheated at a temperature of between 100° and 150° C., for example, of 110° C., by means of a hot roller 4. The preheated yarn is drawn between the hot roller 4 and the draw roller 6 at a draw ratio of between 1.5 and 2.0, for example, of 1.85, while it is heated at a temperature of at least 150° C., for example, of 180° C., by means of the plate heater. After leaving the draw roller 6, the drawing tension in the yarn is released so that the bulkiness is applied to the yarn due to the difference in the elasticity recovery properties of the constituent yarns.

When an undrawn modified polyester including a third component, such as a polyester dyeable with cationic dyes, and a partially undrawn polyester, i.e., a so-called POY polyester, are preliminarily interlaced to be mixed into a unitary yarn, and then, the mixed yarn is drawn at a draw ratio which is equal to or smaller than the natural draw ratio of the undrawn yarn and which is equal to or larger than the natural draw ratio of the partially undrawn yarn while the yarn is heated at a predetermined temperature. When the drawing tension is released after the drawn yarn leaves the drawing zone, the yarn becomes bulky due to the difference in the elastic recovery properties. More specifically, the bulky yarn comprises a core portion resulting from the partially undrawn yarn and a sheath or wrapper portion resulting from the undrawn yarn dyeable with cationic dyes, and therefore, the obtained bulky yarn has a heather like appearance and a pill resistance.

An actual example of this process will now be explained with reference to FIG. 1. Reference numeral 1 denotes an undrawn modified polyester yarn including 2.5 mol % of 5-sulfosodium isophthalic acid, spun at a speed of 900 m/min and having a natural draw ratio of 2.7, and 2 denotes a partially oriented usual polyester spun at a speed of 3500 m/min, having no special third component and having a natural draw ratio of 1.3. The yarns 1 and 2 were uniformly interlaced into a unitary yarn by means of a pneumatic interlacing nozzle 3. Thereafter, the unitary yarn was preheated at a temperature of 120° C. by way of a hot roller 4, and furthermore, it was drawn at a draw ratio of 1.8 between the hot roller 4 and a draw roller 6 while it was heated at a temperature of 200° C. by means of a plate 5. Then the drawn yarn was taken up by way of a take up 7 at a winding tension lower than a drawing tension.

Since the undrawn yarn 1 was drawn at a draw ratio lower than its natural draw ratio, the yarn 1 was subjected to a slight plastic deformation. Accordingly, after the yarn 1 left the draw roller so that the draw tension therein was released, the yarn 1 slightly recovered due to its elastic recovery property. Contrary to this, since the partially drawn yarn 2 was drawn at a draw ratio higher than its natural draw ratio, the yarn 2 was subjected to a large elastic recovery force. Therefore, when the draw tension was released, the yarn 2 tended to recover due to its large elastic recovery property. Because the yarns 1 and 2 were previously interlaced, a number of bulges were formed as illustrated in FIG. 5 due to the differences in the elastic recovery properties, and a bulky flat yarn was produced.

When the produced bulky flat yarn was woven or knitted into a fabric, a soft and bulky woven or knitted fabric could be obtained.

If a rough woven or knitted fabric is formed by utilizing a usual undrawn yarn as the undrawn yarn designated by reference numeral 1 above, the filaments located at the surface can be floated, and the floated filaments can entangle with each other to form a so called pilling condition. If the denier of individual filaments constituting the undrawn yarn is small, the above-explained tendency becomes high. Contrary to this, in the above-explained example, since a modified polyester was utilized as the undrawn yarn 1, the occurrence of the pilling was reduced as shown in the following table.

| Polymer Component | Usual Polyester | | Modified Polyester | |
|---|---|---|---|---|
| Thickness of Individual Filaments constituting yarn 1 (After drawing process) | 3 de | 1.5 de | 3 de | 1.5 de |

-continued

| Polymer Component | Usual Polyester | | Modified Polyester | |
|---|---|---|---|---|
| Pilling Characteristic (Grade) | 3 | 1~2 | 4~5 | 4 |

Contrary to this, when an undrawn polyester and a partially undrawn polyester including a third component and spun at a speed higher than that used for spinning the undrawn polyester, such as a polyester dyeable with a cationic dyes, are treated in a manner similar to that explained just above, a bulky yarn comprising a core portion resulting from the partially undrawn yarn dyeable with cationic dyes and a wrapper portion resulting from the undrawn yarn is produced. Due to the high dyeability of the core portion, a bulky yarn which is free from irritating appearance can be obtained.

An example of this process will now be explained.

A partially oriented modified polyester yarn including 5-sulfosodium isophthalic acid and spun at a speed of 2800 m/min was used as an undrawn yarn 2, and a compound yarn was manufactured in a manner similar to that of the above explained example.

When the manufactured yarn was first dyed in disperse dyes and then dyed with cationic dyes, the color difference between the yarns 1 and 2 became very small, because only the modified polyester was dyed in the cationic dyes.

It is preferable that the undrawn yarn 1 is obtained through a melt spinning process at a usual low spinning speed of, for example at most 2000 m/min and that the partially oriented yarn 2 is manufactured through a high speed melt spinning of, for example at least 2800 m/min. In addition, a partially oriented yarn produced by a usual method for manufacturing a partially oriented yarn, such as rapid quenching method, could be used.

Furthermore, an undrawn polyester yarn and a partially undrawn yarn are mixed together into a combined filament yarn, and after the filament yarn is drawn, the drawn yarn is heat treated at a temperature of at least 180° , the constituent filaments are hardened and partially fused, and accordingly, a bulky yarn having a dry hand is produced.

Figure 18:
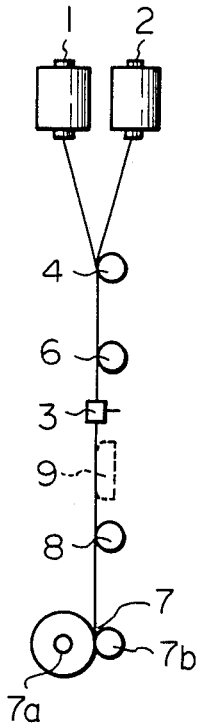
Figure 19:
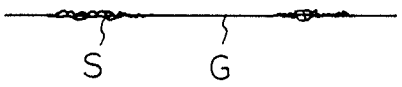
FIG. 19 is a diagrammatical side view of a yarn obtained through a process of the present invention.
Figure 20A:
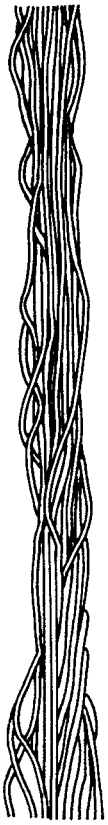
FIGS. 20A and 20B are side views of portions S and G, respectively, in the yarn illustrated in FIG. 19.
Figure 20B:
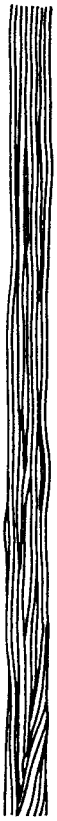

In another aspect of the present invention, irregularity in drawing is formed in one of the supplied undrawn yarns after the yarns are drawn, and then the drawn yarns are mixed by means of an interlacing air nozzle. According to the irregularity in drawing, uneven yarn, similar to a slub yarn, having irregular thickness can be obtained. In a method for forming irregularity in drawing, the undrawn yarns are heated at a relatively low temperature, i.e., a temperature of at most the glass transient temperature plus 20° C., and are drawn at a relatively low temperature, i.e., a temperature of between room temperature and 90° C. In an embodiment of this aspect, an apparatus illustrated in FIG. 18 is used, and 1 denotes an undrawn polyester yarn, for example, of 115 denier/36 fil, having a natural draw ratio of 1.3 and spun at a spinning speed of 3500 m/min, and 2 denotes an undrawn polyester yarn spun at a speed lower than that of the yarn 1, for example, of 2000 m/min, of 150 denier/48 fil and having a natural draw ratio 1.9. The undrawn yarns 1 and 2 are preheated at a temperature, for example, of 75° C., by means of a hot roller 4, and then the preheated yarns 1 and 2 are drawn at a draw ratio, for example of 1.6, of between the natural draw ratio 1.3 and 1.9 between the hot roller 4 and a draw roller 6. A delivery roller 8 disposed beneath the draw roller 6 is rotated at a peripheral speed lower than that of the draw roller 6 by 6%. As a result, the yarn 1 shrinks due to the elasticity between the draw roller 6 and the delivery roller 8. Contrary to this, the yarn 2 which has a natural draw ratio of 1.9 and which is subjected to the draw ratio of 1.6 being smaller than its natural draw ratio is irregularly drawn because it is not heated to such an excessively high temperature while it is being drawn. In other words, in the yarn resulting from the undrawn yarn 2, fully drawn portions and partially drawn portions are presented randomly along its length, and a so-called thick and thin condition occurs. The yarn resulting from the undrawn yarn 2 is not sufficiently shrunk after it leaves the draw roller 6 as if it is being overfed. The yarns resulting from the undrawn yarns 1 and 2 are together subjected to an interlacing operation by means of the interlacing air nozzle 3. As a result, the slack portion in the yarn resulting from the undrawn yarn 2 is wrapped around the core portion resulting from the undrawn yarn 1 to form a bulky interlaced portion S in FIG. 19. Contrary to this, the fully drawn portion in the yarn resulting from the undrawn yarn 2 forms, together with the core portion, a portion G in FIG. 19 since the difference in the lengths of the yarns is slight. As explained above, the irregularity in drawing creates not only irregularity in dyeability but also changes in bulkiness which generates unevenness in thickness as a natural slub yarn. The irregularity of the present invention can be recognized even when the yarn is not dyed, and such a heather like appearance can be recognized when the yarn is woven in a plain weave, or when it is light colored or formed in a print cloth. FIGS. 20A and 20B illustrate a sample of a yarn according to this aspect, wherein FIG. 20A illustrates a bulky interlaced portion S, and FIG. 20B illustrates a portion G with a low bulk.

We claim:

1. A process for manufacturing a bulky flat yarn, wherein during said process a single type of spin finish is applied to said yarn, said process comprising the steps of:

a. providing a first polyester yarn which has been produced at a spinning speed of less than 2000 m/min and which has a birefringence of at most 0.018, b. providing a second polyester yarn which has been produced at a spinning speed of more than 2800 m/min and which has a birefringence of at least 0.023, c. interlacing said first and second yarns in a not fully drawn state, d. subjecting said yarns to different stresses by simultaneously drawing the interlaced polyester yarns at a draw ratio at least equal to the smallest natural draw ratio of said yarns and not exceeding the lesser of:

i. the largest natural draw ratio of said yarns, and ii. the smallest breaking elongation of said yarns while they are being subjected to said drawing step; and e. relaxing the drawing tension on said yarns so that when the drawing tension is relieved, the filaments of one of said yarns contrast less than the filament of the other of said yarns, and the filaments of said one of said yarns bulge out at a pitch not greater than the distance between adjacent interlace points, giving the composite yarn an apparent bulkiness.

2. A process according to claim 1, further comprising a step of mixing said yarns by means of a turbulent fluid nozzle.

3. A process according to claim 2, wherein said mixing step by means of said turbulent fluid nozzle is carried out over yarns delivered under a slackened condition of between 0.5 and 5.0%, and after said yarns are subjected to said drawing step while they are being heated, the drawing tension is released from said yarn so that bulkiness is caused in said flat yarn due to the difference in the elasticity recovery properties of said yarns.

4. A process according to claim 1, wherein one of said yarns is an undrawn polyester yarn having a birefringence of at most 0.018 and another yarn of said yarns is a partially oriented polyester yarn (PET-POY) having a birefringence of at least 0.023.

5. A process according to claim 1, which further comprises the step of preheating said prepared yarns prior to said drawing step.

6. A process according to claim 1, wherein said yarns are subjected to said preheating step at a temperature of between the glass transient temperature plus 30° C. and the glass transient temperature plus 80° C.

7. A process according to claim 1, wherein said yarns are heated at a temperature of at least 150° C. while they are being subjected to said drawing step.

8. A process according to claim 1, wherein one of said yarns is an undrawn polyester yarn, and another yarn of said yarns is a partially drawn polyester yarn spun at a high speed and including a third component, and after said undrawn yarn and said partially drawn yarn are mixed, they are subjected to said drawing step at a draw ratio of at most the natural draw ratio of said undrawn yarn and at least the natural draw ratio of said partially drawn yarn while they are being heated, and then the drawing tension in said yarns is released, so that bulkiness is caused in said flat yarn due to the difference in the elasticity recovery properties of said yarns.

9. A product prepared by the process of claims 2, 3, 4, 5, 6, 7, or 8.

* * * * *